US005163847A

United States Patent [19]

Regnier

[11] Patent Number: 5,163,847

[45] Date of Patent: Nov. 17, 1992

[54] CARD EDGE CONNECTOR ASSEMBLY

[75] Inventor: Kent E. Regnier, Lombard, Ill.

[73] Assignee: Molex Incorporated, Lisle, Ill.

[21] Appl. No.: 740,366

[22] Filed: Aug. 5, 1991

[51] Int. Cl.[5] ..... H01R 13/00

[52] U.S. Cl. ..... 439/157; 439/680

[58] Field of Search ..... 439/152, 153, 157, 159, 439/160, 629-637, 680, 681

[56] References Cited

U.S. PATENT DOCUMENTS

| | | | |
|---|---|---|---|
| 2,765,450 | 10/1956 | Richardson | 439/633 |
| 2,935,725 | 5/1960 | Fox | 439/633 |
| 4,152,038 | 5/1979 | Inouye et al. | 439/157 |
| 4,410,222 | 10/1983 | Enomoto et al. | 439/157 |
| 4,713,013 | 12/1987 | Regnier et al. | 439/62 |
| 4,806,103 | 2/1989 | Kniese et al. | 439/637 |

*Primary Examiner*—Joseph H. McGlynn
*Attorney, Agent, or Firm*—Charles S. Cohen

[57] ABSTRACT

A card edge connector assembly includes an elongated housing having opposite ends with card injection and ejection levers thereat, and a card receiving slot between the ends. A printed circuit card has an edge insertable into the slot. The edge of the card is provided with a notch for embracing a partition spanning the slot of the housing to locate the card longitudinally of the housing. The partition of the housing and the notch in the card edge are complementarily offset from a midpoint of the slot to provide polarization between the card and the housing. Each insertion and ejection lever includes a plurality of spaced projections for interengagement with a plurality of recesses in an adjacent side edge of the printed circuit card. The projections move seriatim into and out of the recesses in response to pivoting of the lever to thereby insert and eject the card to and from the slot in response to pivoting the lever between the latched position and the eject position.

15 Claims, 5 Drawing Sheets

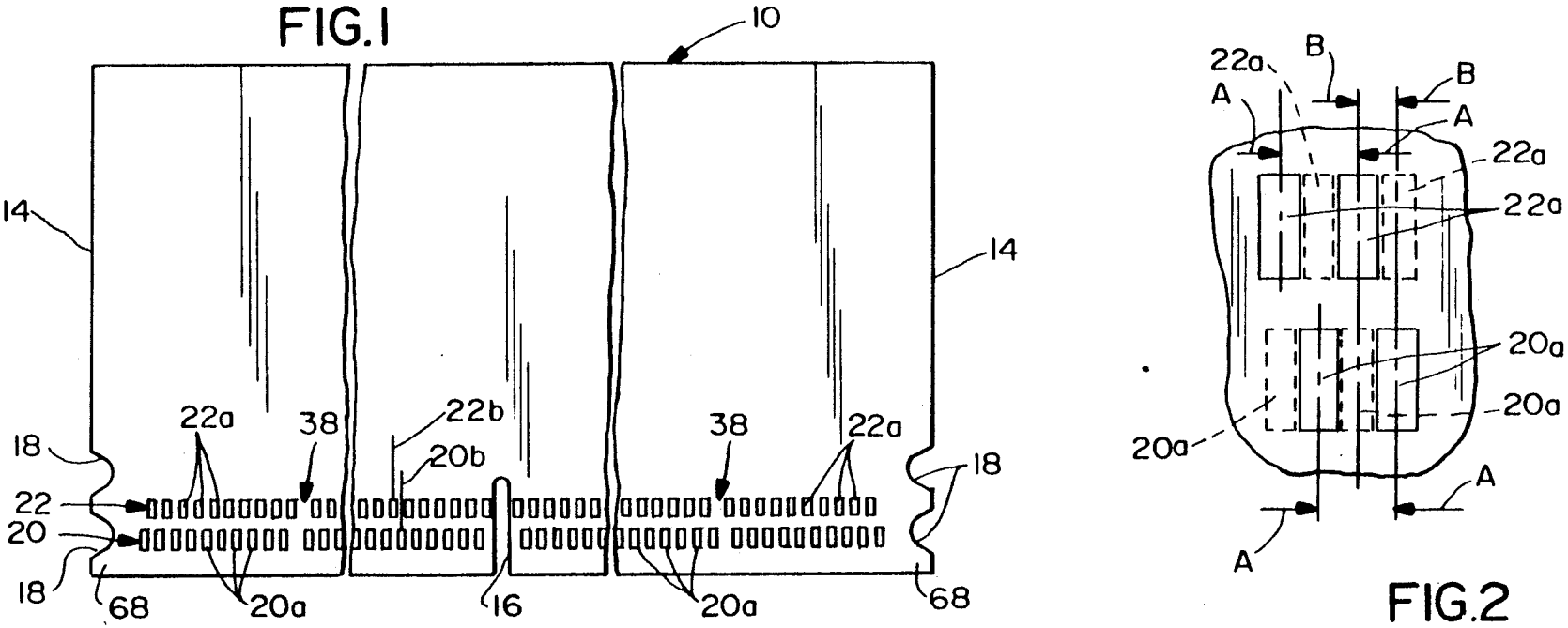
FIG.1
10
14
18
68
22a
38
20a
16
22b
20b
22
20
FIG.2
A
B
22a
20a
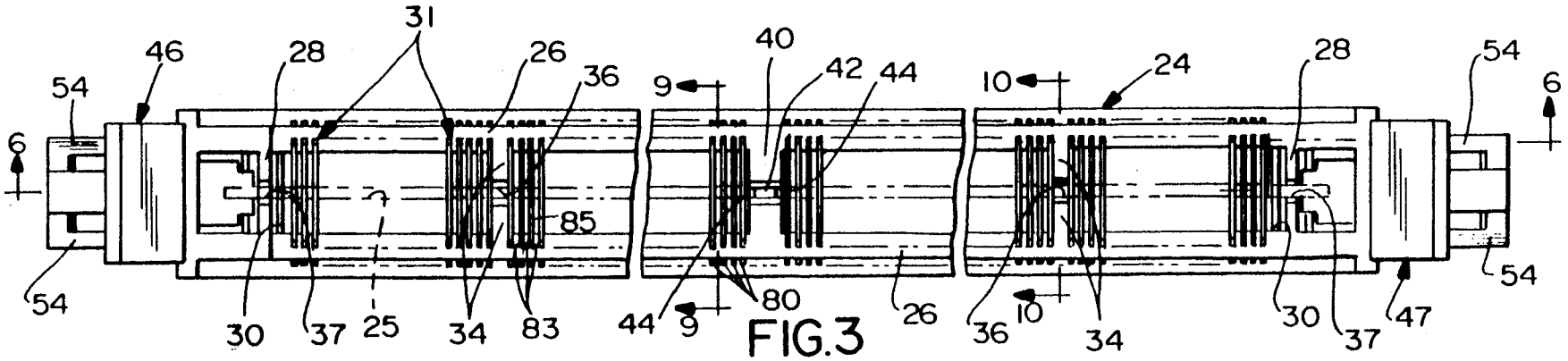
FIG.3
6
54
47
37
28
30
24
34
36
10
26
44
42
40
80
9
83
85
31
25
46

CARD EDGE CONNECTOR ASSEMBLY

FIELD OF THE INVENTION

This invention generally relates to the art of electrical connectors and, particularly, to an electrical connector assembly for receiving the edge of a printed circuit card having conductive pads along the edge thereof.

BACKGROUND OF THE INVENTION

Electrical connector assemblies for making large numbers of interconnections are used extensively in the electrical connector industry, such as for use in computers and other electronic devices. With the ever-increasing miniaturization of the electronics in such devices and the ever-increasing density of the related connector assemblies, continuing problems occur in designing connectors for such use. This is particularly true with connectors commonly known as card edge connectors which are constructed to receive printed circuit cards having conductive pads on one or both sides of the card along the edge of the card which is inserted into the connector assembly.

One of the problems encountered with such high-density electrical connector assemblies is the provision of means for locating the printed circuit card properly in a card receiving slot means of the connector assembly for engaging respective contact elements mounted in the housing of the connector assembly along the card receiving slot. Heretofore, partitions were typically provided on the housing, projecting inwardly of a cavity thereof, the partitions separating the respective contact elements. The inner edges of the partitions normally defined the slot for receiving the printed circuit card. However, with high density circuitry on the card, as described above, it has become difficult, if not impossible, to mold a housing wherein plastic can flow into extremely small cavities to define partitions between the contact elements which may have to be on the order of 0.030 inch pitch.

Another problem in designing electrical connector assemblies of the character described is in providing means to assist insertion and ejection of the printed circuit card from the card edge connector assembly. As the number of contact elements that engage the printed circuit card increases, the forces required for insertion and ejection of the card increase. Accordingly, means for assisting in the insertion and ejection of the card without bending or damaging the card is desirable.

Applicant achieves this result by providing insertion/ejection levers that contact the side edges of the printed circuit card. This, however, creates another problem. Typically, the end walls of the connector housing act to provide longitudinal alignment between the contact elements and the conductive pads on the card. Through the use of such insertion/ejection levers, the end walls that contact the sides of the card are eliminated thus creating a potential alignment problem.

This invention is directed to solving various problems, including those described above, in designing card edge connector assemblies for high density printed circuit cards.

SUMMARY OF THE INVENTION

An object, therefore, of the invention is to provide a new and improved card edge connector assembly of the character described.

In one embodiment of the invention, the card edge connector assembly includes an elongated housing having opposite ends with card latch means thereat to engage side edges of a printed circuit card, and with means defining card receiving slot means between the ends. The printed circuit card has an edge insertable into the slot means. According to one aspect of the invention, complementary card locating means are provided between the printed circuit card and the housing, intermediate the ends of the housing, for locating the card longitudinally of the housing. The card locating means, is the sole locating means, exclusive of the latch means for properly locating the card longitudinally of the housing.

More particularly, the complementary interengaging card locating means is provided in the form of a partition on the housing spanning the slot means, and a notch is provided in the mating edge of the card for embracing a portion of the partition. Preferably, the partition is offset from a mid-point of the slot means, and the notch in the card is correspondingly offset from a midpoint of the length of the card, to provide polarization means for the card relative to the housing. The portion of the partition that mates with the notch is tapered and has lead-ins to accurately position and guide the notch in the edge of the printed circuit card. In the exemplary embodiment of the invention, a substantial portion of the body of the partition is wider than the notch in the printed circuit card, and the partition has groove means within which the notch engages to thereby locate the card laterally of the housing. Lateral positioning is further provided by additional projections that extend inwardly from the side walls and the end walls.

According to another aspect of the invention, in order to assist insertion and ejection of the printed circuit card into and out of the card receiving slot means of the housing, the card has side edges each provided with at least a pair of spaced recesses or notches. A latching and ejecting lever means is pivotally mounted on the housing at each end thereof for movement between a latching position and an eject position. The lever means include at least a pair of spaced projections for interengagement in the recesses in the adjacent side edge of the printed circuit card. The projections move seriatim into and out of the recesses in response to pivoting of the lever means to thereby insert the card into the slot in response to pivoting the lever means toward the latching position, and to eject the card from the slot in response to pivoting the lever means toward the eject position.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIG. 1 is a side elevational view of a printed circuit card of the present invention for use with the card edge connector assembly of the invention;

FIG. 2 is a fragmented elevational view, on an enlarged scale, showing two pairs of pads in each row of conductive pads on the printed circuit card of FIG. 1;

FIG. 3 is a top plan view of the card edge connector assembly of the invention with the contact elements removed;

DETAILED DESCRIPTION OF THE PREFERRED EMBODIMENT

Figure 4:
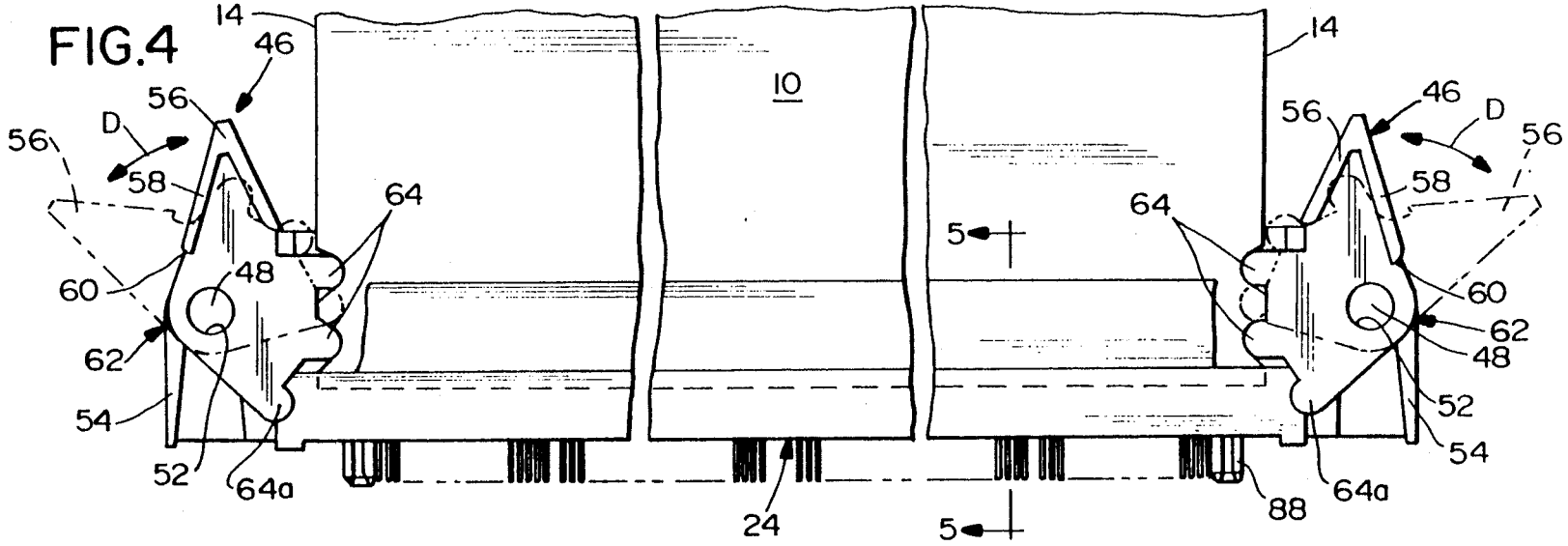
FIG. 4 is a side elevational view of the connector assembly, with the ends thereof cut away to illustrate the latching and ejecting lever means.

Referring to the drawings in greater detail, and first to FIG. 1, the invention is directed to a card edge connector assembly, described below, for use in conjunction with a printed circuit card, generally designated 10. The card has an elongated insertion edge 12 and opposite side edges 14. For purposes described hereinafter, insertion edge 12 is provided with a locating notch 16, and each side edge 14 is provided with a pair of spaced insertion/eject rounded notches 18.

Generally, printed circuit card 10 has two rows, generally designated 20 and 22, of conductive pads 20*a* and 22*a*, respectively, in linear arrays running generally parallel to insertion edge 12 of the card. Although not shown in the drawings, each conductive pad 20*a* and 22*a* is connected by means of circuit traces 20*b* and 22*b* to appropriate circuitry (not shown) on the card as is known in the art. Only two circuit traces 20*b* and 22*b* are shown in FIG. 1 in order not to clutter the illustration. It can be seen that row 20 of conductive pads 20*a* are located nearer to insertion edge 12 of the card than is row 22 of conductive pads 22*a*.

Referring to FIG. 2 in conjunction with FIG. 1, a pair of each of the conductive pads 20*a* and 22*a* from the respective rows thereof are isolated to illustrate the high density of printed circuit card 10. In particular, as represented by arrows "A", conductive pads 20*a* in row 20 and conductive pads 22*b* in row 22 have equal spacing which is approximately 0.060 inches. It can be seen that the conductive pads in each row are staggered relative to the pads in the other row. Therefore, the spacing or pitch between alternating conductive pads in the combined rows, as represented by arrows "B", is half of "A" or approximately 0.030 inches. It should be noted that this array of conductive pads 20*a* and 22*a* in rows 20 and 22, respectively, is repeated on the opposite side of printed circuit card 10 but the rows on one side of the card are offset from the rows on the opposite side.

Figure 11:
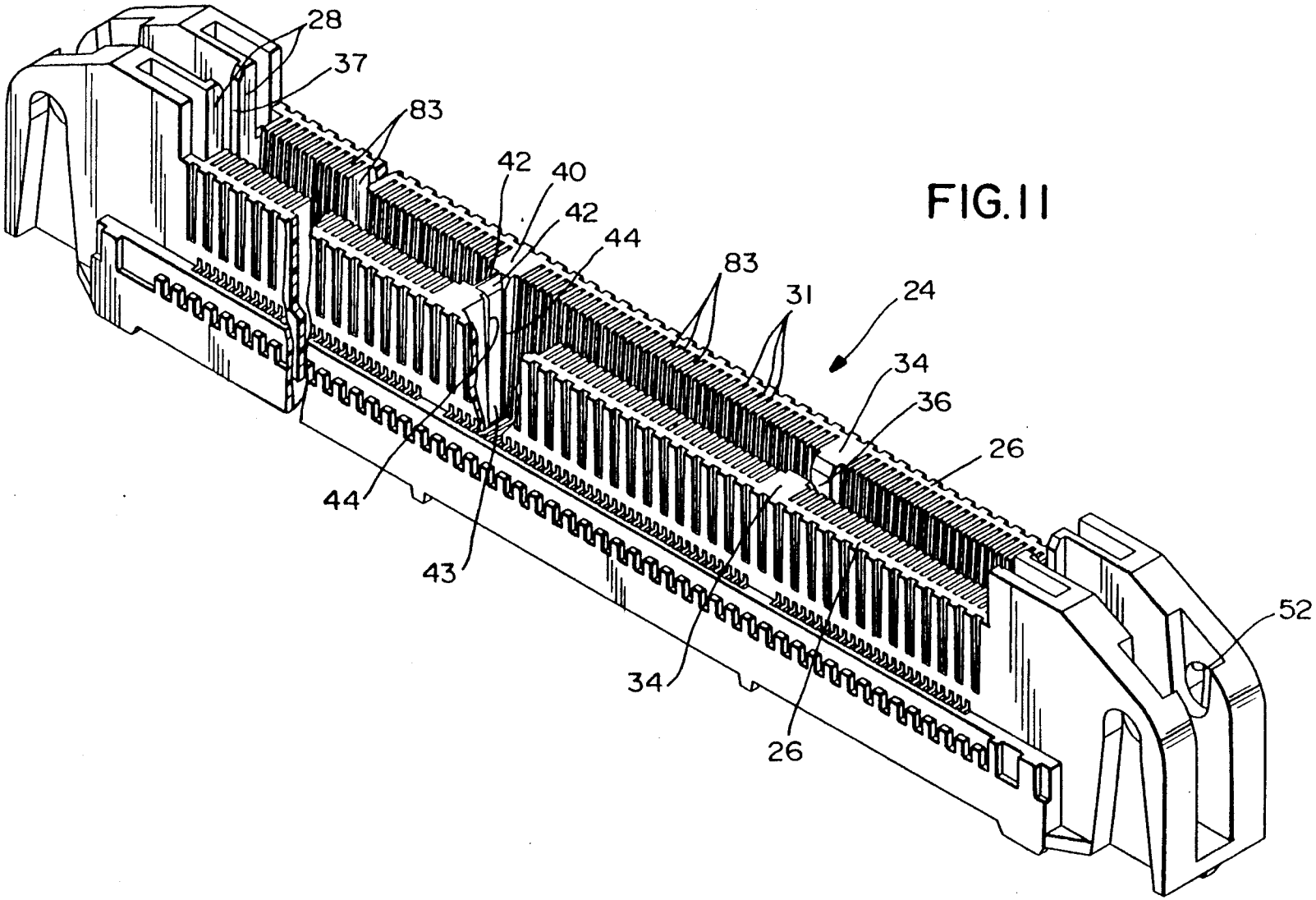
FIG. 11 is a fragmented perspective view of the conductor housing shown in FIG. 6.

Referring to FIGS. 3 and 11, the card edge connector assembly of the invention includes an elongated housing, generally designated 24, which is unitarily molded of a dielectric material. The housing has opposed side walls 26 and opposite end walls 28 which define an elongated interior cavity 30 therewithin. A plurality of contact elements are mounted in contact receiving cavities 31 in housing 24 with contact portions projecting towards the center of cavity 30, as will be described in relation to FIG. 5 hereinafter. The contacts are spaced or have a pitch that is complementary to the pitch of conductive pads 20*a* and 22*a* as described in relation to FIG. 2. This high density, i.e., small pitch, between the contact elements prevents the molding of partition walls between the contact elements that extend far enough towards the center of housing 24 to define the lateral component of a card receiving slot, as heretofore has been done.

The lateral component of the card receiving slot 25 of housing 24 is provided, in part, by two pairs of opposing partition portions 34 which define openings between inner edges 36 of the partition portions. Each pair of end walls 28 also similarly have opposed inner edges that define an opening 37 therebetween. The openings defined by inner edges 36 and 37 are in alignment longitudinally of the housing to define a portion of the lateral component of the card receiving slot 25. Referring back to FIG. 1, gaps, generally designated 38, are provided in each row 20 and 22 of conductive pads 20*a* and 22*a*, respectively, to accommodate partition portions 34. In essence, one conductive pad is eliminated from each respective row 20 and 22 in order to accommodate each partition portions 34.

The invention contemplates the provision of complementary interengaging card locating means between printed circuit card 10 and housing 24 intermediate the ends of the housing for locating the card longitudinally of the housing. Because of the high density circuitry involved in the card edge connector assembly of the invention, preferably the card locating means is the sole locating means, exclusive of the latch means described hereinafter, for properly locating the card longitudinally of the housing.

Figure 6:
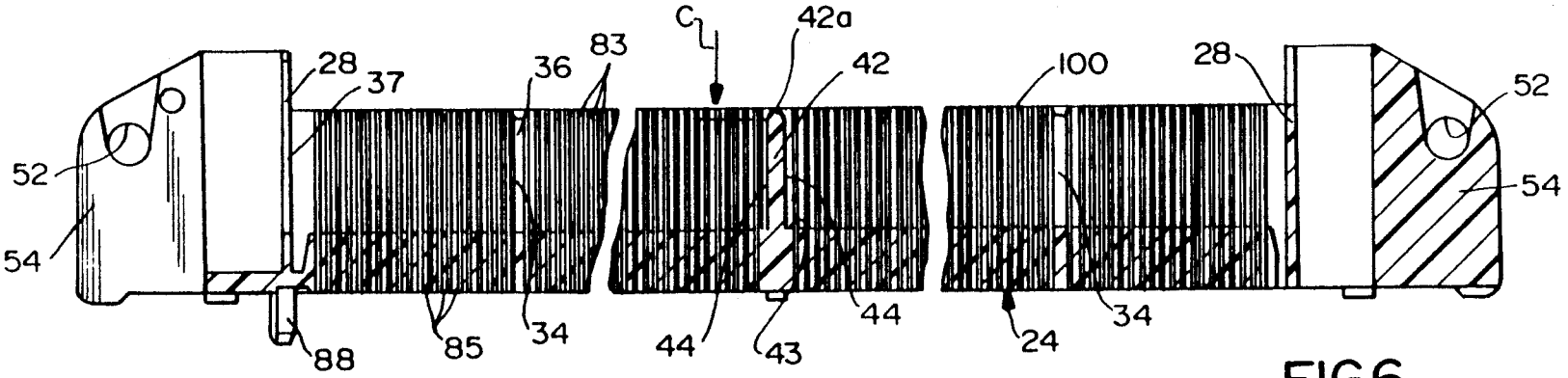
FIG. 6 is a vertical section taken generally along line 6—6 of FIG. 3, with the contact elements and latching and ejecting lever means removed to facilitate the illustration of the connector housing.

More particularly, referring to FIG. 6 in conjunction with FIG. 2, a center partition 40 spans cavity 30 and is integrally molded with and between side walls 26 of the housing. This partition serves multiple functions in laterally supporting side walls 28, in longitudinally and laterally locating the printed circuit card and in polarizing the printed circuit card relative to the housing.

Center partition 40 includes a center narrow portion 42 which has a width (in a direction longitudinally of the housing) to be embraced by notch 16 (FIG. 1) of printed circuit card 10 when the card is inserted into the housing. As seen in FIG. 6, the top 42*a* of partition portion 42 has a tapered lead-in to facilitate guiding notch 16 over the partition in the insertion direction as indicated by arrow "C". Although difficult to see in the Figures, narrow portion 42 is also tapered along its length so that its widest point is at 43 in order to accurately position card 10 longitudinally to define the longitudinal position of card receiving slot 25.

Partition 40, preferably is offset to one side of a mid-point between opposite ends 28 of housing 24, and notch 16 in printed circuit card 10 correspondingly is offset from a mid-point thereof, to provide polarization means for the card relative to the housing.

In addition to the functions of longitudinally locating the printed circuit card, supporting side walls 26 of the housing and polarizing the circuit card relative to the housing, partition 40 also combines with partition portions 34 and end walls 28 to define the lateral boundary of card receiving slot 25. In particular, it can be seen that with the major body portions of partition 40 being wider than the narrower portion 42 which is embraced by notch 16 of the card, shoulders 44 generally parallel to side walls 26 are provided for engaging the sides of the printed circuit card. These shoulders 44 are in alignment with the inner edges 36 of partition portions 34 and inner edges 37 of end walls 28 to combine therewith to define the lateral position of the card receiving slot 25 of the housing.

Referring to FIG. 4 in conjunction with FIG. 3, the invention contemplates the provision of insertion and ejecting latch arms at the opposite ends of housing 24 for assisting in inserting printed circuit card 10 into the card receiving slot means of the connector assembly and ejecting the card therefrom.

More particularly, a latching and ejecting lever arm, generally designated 46, is provided at each opposite end of housing 24. Each lever arm is pivotally mounted to the housing about a shaft 48 dimensioned to rotate within hole 52 in laterally spaced wing portions 54 of housing 24. It is contemplated that the shaft 48 could either be a dowel pin inserted into arm 46 or an integrally molded portion of arm 46.

Each lever arm 46 is pivotally movable between a latching or insertion position shown in full lines in FIG. 4, and an eject position shown in phantom lines in FIG. 4, as indicated by double-headed arrow "D". Each lever means 46 has a projecting actuating portion 56 for engagement by an operator's thumb or finger. The actuating portion has laterally outwardly projecting flanges 58 terminating in distal ends 60 for engaging wing portions 54 of the housing to define stop means, as at 62, which defines the ejecting position of the lever means and also defines the loading position of the printed circuit card.

In order to interengage each lever means 46 with opposite edges 14 of printed circuit card 10, each lever means is provided with at least a pair of rounded projections 64 which nest for interengagement within rounded recesses 18 (FIG. 1) in side edges 14 of the printed circuit card. In operation, the projections move seriatim into and out of the recesses in response to pivoting of the lever means to thereby insert the card into the slot means of housing 24 in response to pivoting of the lever means toward the latching position shown in full lines in FIG. 4, and to eject the card from the slot means in response to pivoting the lever means toward the eject position as shown in phantom in FIG. 4. The interengagement of the plural projections 64 of the lever means in the plural recesses 18 in the printed circuit card provides a sort of rack-and-pinion arrangement to permit the insertion/ejection of the printed circuit card without the user contacting the card and possibly bending or otherwise damaging it.

Still further, each lever arm 46 is provided with a third projection **64*a* which, when the lever means is in its eject or loading position, provides a locating means for corners 68 (FIG. 1) of the printed circuit card to seat the card when an operator initially positions the card before actuating or pivoting the lever arm to insert the card into the slot 25 of the housing. This enables the operator to easily position the card and then move actuating portions 56** of the lever arm inwardly toward the card simultaneously to insert the card fully into the connector assembly.

Figure 5:
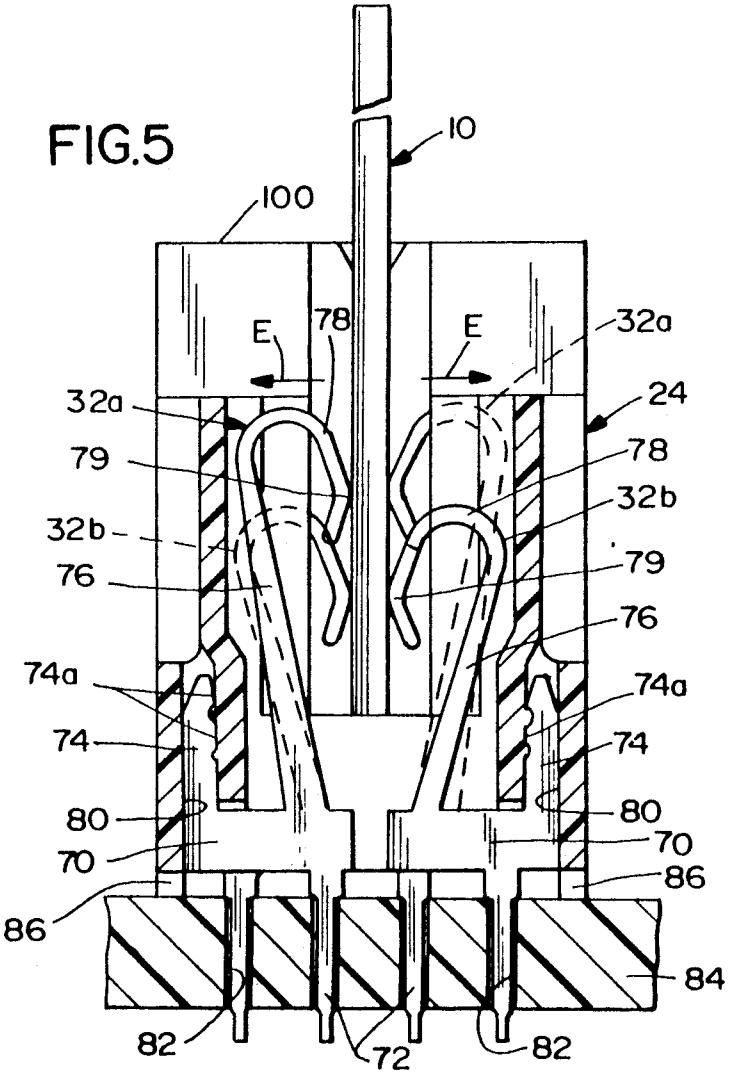
FIG. 5 is a vertical section taken generally along line 5—5 of FIG. 4.
Figure 8:
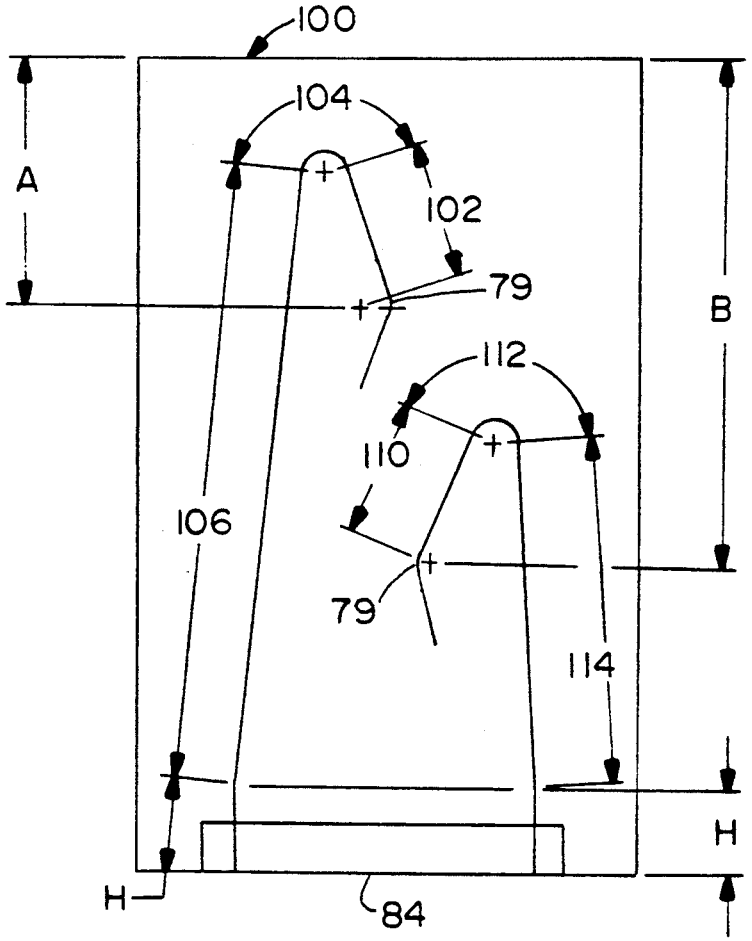
FIG. 8 is a schematic view of the contact elements illustrating the path lengths of the contact elements.
Figure 9:
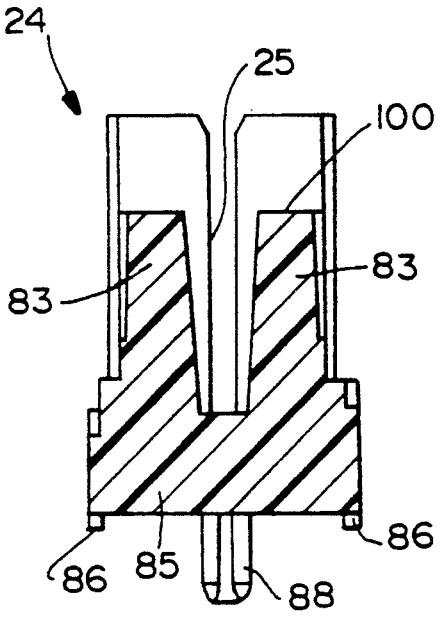
FIG. 9 is a vertical section taken generally along line 9—9 of FIG. 3 with the latch arm removed for clarity.
Figure 10:
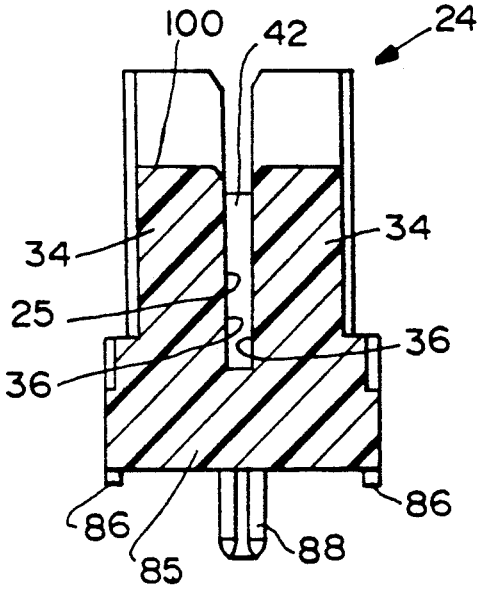
FIG. 10 is a vertical section taken generally along line 10—10 of FIG. 3 with the latch arm removed for clarity.

Referring to FIG. 5, the contact elements of the present invention are shown in detail. Specifically, the contact elements include what, for simplicity purposes, will be termed long contact elements, generally designated **32*a*, and short contact elements, generally designated 32*b*. Such contacts are stamped from a sheet of metal, preferably in pairs of opposed long and short contact element which are retained on a carrier strip (not shown) until insertion into housing 24**. The contact elements are similar to those disclosed in co-pending application Ser. No. 501,577, filed on Mar. 30, 1990, which is incorporated herein by reference.

Each contact element includes a base 70, a solder tail 72 projecting downwardly from the base, a locking arm 74 projecting upwardly from the base, a beam section 76 projecting angularly upward from the base, and a generally inverted U-shaped contact portion 78 formed at the upper end of beam section 76. Base 70 of each contact is rigidly mounted within housing 24 by means of locking arm 74 pressed into passages 80 in the housing. Locking arms 74 have barbs **74*a* for digging into the plastic material of the housing within the passages 80. Solder tails 72 are provided for insertion into holes 82 in a printed circuit board 84 for soldering to circuit traces on the board and/or within the holes. To that end, housing 24 has standoffs 86 for spacing the housing from the printed circuit board, and the housing has conventional board lock pegs 88 (FIG. 4**) for locking the housing to the printed circuit board at least prior to soldering procedures.

Although similarly shaped, the beam section 76 of long contact element **32*a* is different from that of short contact element 32*b*. In particular, the long contact element 32*a* and short contact element 32*b* are configured so that each exerts an equal normal force on its respective contact pad 22*a* and 20*a* at contact point 79 of contact portion 78 when the long and short contact elements are displaced an equal amount. In order to achieve this result, since the contact point 79 of long contact element 32*a* is further from its base 70 than contact point 79 of short contact element 32*b* is from its base 70, the combination of beam section 76 and contact portion 78 of long contact element 32*a* must have a spring rate equal to that of the combination of beam section 76 and contact portion 78 of short contact element 32*b*. Since the contact portions 78 of both contact elements are identically shaped, beam section 76 of long contact element 32*a* is shown as being wider (transverse to the housing 24 as shown in FIG. 5) than the beam section of short contact element 32*b*** at equal distances along their respective beams from their respective bases. Of course, other configurations could be utilized to achieve such equal normal forces including stamping the long and short contact elements from different thickness materials.

Contact portions 78 at the end of beam sections 76 of long and short contact elements **32*a* and 32*b*, respectively, are mounted within housing 24 of the connector assembly in opposing pairs spaced longitudinally of the housing such that contact portion 78 of one long contact element 32*a* engages one of the conductive pads 22*a* in one of the rows 22 thereof on the respective side of printed circuit card 10. Contact portion 78 of the opposed short contact element 32*b* engages the conductive pad 20*a* in the row 20 thereof on the opposite side of printed circuit card 10. On each side of the housing 24, the long and short contact elements alternate. As a result, the end of one side wall begins with a short contact element and the other side wall begins with a long contact element. With an understanding that contact elements 32***a* and 32*b* are mounted within housing 24 in pairs thereof projecting perpendicular to side walls 26 of the housing as shown in FIG. 5, the arrays of conductive pads 20*a* and 22*a* on opposite sides of printed circuit card 20 must be correspondingly arranged. In other words, "looking through" printed circuit card 10 in FIGS. 1 and 2, one conductive pad 20*a* on one side of the printed circuit card will be positioned beneath one conductive pad 22*a* on the opposite side of the printed circuit card. This is why the printed circuit card must be polarized within the connector assembly.

Figure 7:
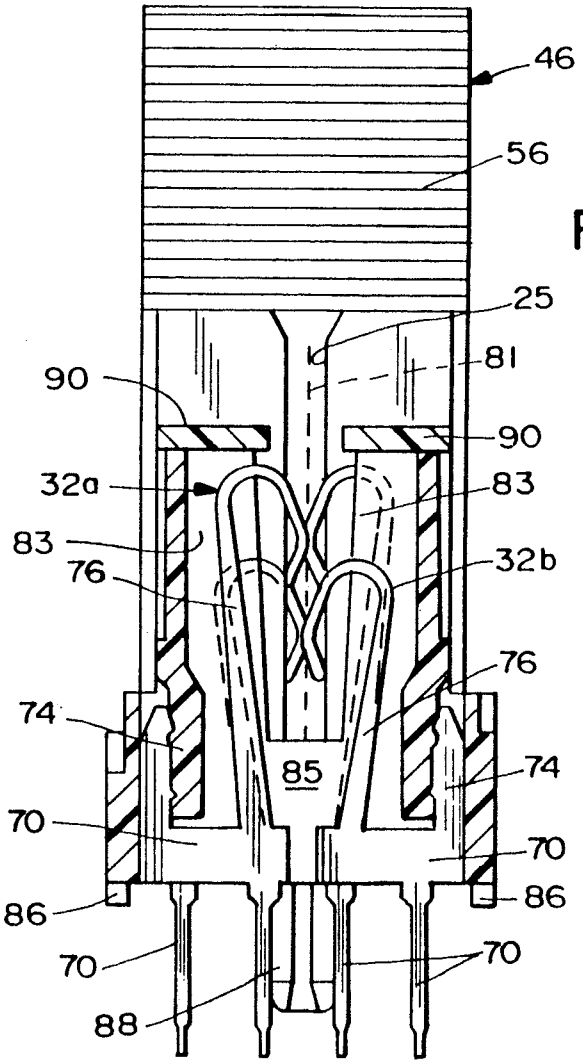
FIG. 7 is a vertical section similar to that of FIG. 5, with the printed circuit card removed to show the contact elements in their unbiased condition.

As shown in FIG. 7, which depicts the contact elements in an undeflected state, contact point 79 of each contact element extends slightly across the lateral centerline 81 of the card receiving slot 25. However, because the contact elements are arranged in opposed pairs of long and short contact elements 32*a* and 32*b*, the opposed contacts do not touch each other. By extending the contact point past the centerline, the contact point of each element is able to travel a greater distance without the beam section 76 contacting side wall 26. That is, if the contact point 79 did not extend to the centerline 81, the contact elements would not be able to deflect as far before the edge of beam section 76 would contact the inner portion of the side wall 26. This configuration permits the use of a contact element having a lower spring rate which is desirable because it minimizes the affect of manufacturing variations on the forces exerted between the contact elements and their respective pads. As a result, less wear is likely to occur between the contact elements and the pads. Further, if desired, the contact element configuration permits the use of thinner printed circuit cards as compared to those known in the prior art.

Because of the configuration of the contact element, including the fact that they are stamped rather than stamped and formed, they have a greater tendency to bend along the longitudinal axis of the housing. As a result, relatively thin support walls 83 project perpendicularly from each side wall 26 to support the contact elements one each side and prevent them from bending and contacting the adjacent contact elements. Thus, each contact element has a pair of support walls 83 positioned on opposite longitudinal sides thereof. These support walls project inwardly from side walls 26 and upwardly from base support members 85 which span the housing 24 from one side wall 26 to the other. The top of the base support members 85 form the bottom surface of the card receiving slot 25. Due to the close spacing between the contact elements, the support walls 81 must be extremely thin which prevents them from projecting to and defining the edge of card receiving slot 25. Accordingly, as discussed above, partitions 34, end walls 28 and partition 40 act to laterally define the card receiving slot 25.

Finally, as shown in FIG. 7, an optional dust cover 90 can be positioned over a portion of cavity 30 in order to restrict air flow within the cavity. This could be utilized to reduce the build-up of films, oxides and the like on the contact point 79 of the contact elements. Of course, the cover would not impede in any way the insertion and ejection of board 10 to and from the connector housing 24.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A card edge connector assembly for receiving a printed circuit card having an edge insertable into slot means of said assembly, said assembly comprising:

an elongated housing having opposite ends with card latch means thereat and means defining a card receiving slot between the ends;

complementary interengaging card located means between the printed circuit card and the housing intermediate said ends for locating the card longitudinally of the housing, the card locating means being the sole locating means exclusive of said latch means for properly locating the card longitudinally of the housing, the complementary interengaging card locating means comprising a partition on the housing spanning the card slot and a notch in the edge of the card for embracing the partition, and wherein the partition is wider than said notch in the printed circuit card in the longitudinal direction of the housing and the partition has a groove within which the notch engages to thereby assist in defining a portion of the lateral edge of the card slot and in locating the card laterally in the card slot.

2. The card edge connector assembly of claim 1 wherein said partition is offset from a mid-point of the slot means and said notch is correspondingly offset from a mid-point of the length of the printed circuit card to provide polarization means for the card relative to the housing.

3. The card edge connector assembly of claim 1 wherein the top of said partition is tapered to provide guide means for engaging the notch of the printed circuit card with the partition.

4. A card edge connector assembly for receiving a printed circuit card having an edge insertable into slot means of the connector assembly, said card having a plurality of conductive pads adjacent said edge thereof, said assembly comprising:

an elongated housing having opposed side walls, opposed ends with card latch means thereat, means defining a card receiving slot between the ends and the side walls and a longitudinal centerline extending through said card slot, said housing further including a plurality of first partition members projecting toward said longitudinal centerline from said side walls for laterally supporting contact elements located in said housing which contact said conductive pads when said card is inserted into said card slot, said first partition members projecting only part way towards said card slot, and a plurality of second partition members projecting toward said longitudinal centerline from said side walls, said second partition members being wider than said first partition members in a direction parallel to said side walls and said longitudinal centerline and projecting to the edge of said card slot to define the lateral portion of the card slot; and said contact elements each having a contact portion for contacting one of said conductive pads, a tail portion for electrically connecting said contact element to a circuit element of an electronic component, and an elongated body portion extending between said contact portion and said tail portion, said contact elements being oriented as spaced apart pairs laterally aligned along a line perpendicular to said longitudinal centerline, the tail portions of the contact elements of each of the pairs being positioned on opposite sides of said longitudinal centerline.

5. The card edge connector assembly of claim 4 wherein said first and second partition members are integrally formed as part of said housing and said housing is unitarily molded of dielectric material.

6. The card edge connector of claim 5 wherein said contact elements and said housing are configured so that the orientation of the circuit card relative to said housing during insertion thereof into said card slot is identical to the orientation of the circuit card relative to said housing when said circuit card is in its operational position within said housing.

7. The electrical connector of claim 6 wherein said contact elements slidingly engage said conductive pads as said circuit card is inserted into said housing.

8. The card edge connector assembly of claim 4 wherein said housing further comprises a partition spanning of the side walls and the card slot, the partition being offset from a midpoint longitudinally of the card slot, and the top of the partition being tapered, said partition mating with a notch in said card adjacent said edge to provide the sole locating means, exclusive of the latch means, for locating the card longitudinally of the housing and to provide polarization means for the card relative to the housing.

9. The card edge connector assembly of claim 8 wherein said partition includes a major portion thereof which is wider, in the longitudinal direction of the housing, than the notch in the printed circuit card, the partition having groove in said major portion within which the notch engages to thereby define a portion of the lateral edge of the card slot and locate the card laterally in the card slot.

10. An insertion and ejection card edge connector assembly for receiving a printed circuit card having an elongated edge insertable into slot means in the connector assembly and having opposite side edges, each having at least a pair of spaced recesses, each said recess being formed by a pair of straight portions beginning at and extending away from its respective side edge at an angle thereto and each intersecting a common radius at opposite ends thereof, said assembly comprising:

an elongated housing having opposite ends and means defining a card receiving slot means between the ends, said card being insertable into said slot means with each said side edge being positioned adjacent one of said opposite ends;

an injection and ejection lever means pivotally mounted on the housing at each end thereof for movement between a latched position and an eject position, the lever means including at least a pair of spaced projections for interengagement in the recesses in the adjacent side edge of the printed circuit card, the projections being movable seriatim into and out of the recesses in response to pivoting of the lever means to thereby insert the card into the slot means in response to pivoting the lever means toward said latched position and to eject the card from the slot means in response to pivoting the lever means toward said eject position, each projection having a contact surface for contacting one of said recesses during insertion and ejection of the card, each contact surface being a rounded projection of a constant radius.

11. The injection and ejection card edge connector assembly of claim 10, which further includes a third projection on the lever means against which the elongated edge of the printed circuit card is engageable upon initial insertion of the card and prior to engagement of said pair of spaced projections in said pair of recesses.

12. The injection and ejection card edge connector assembly of claim 10 further including stop means between the injection and ejection lever means and the housing to define said eject position.

13. An insertion and ejection card edge connector assembly comprising:

an elongated housing having opposite ends and a card receiving slot extending between said ends;

a mating printed circuit card insertable into said slot and having opposite ends adjacent the opposite ends of the housing when inserted into the cavity, said opposite ends of the card each having at least a pair of spaced recesses, each said recess being formed by a pair of straight portions beginning at and extending away from its respective side edge at an angle thereto and each intersecting a common radius at opposite ends thereof; and an injection and ejection lever arm pivotally mounted on the housing at each end thereof for movement between a latched position and an eject position, the lever arm including at least a pair of spaced, rounded projections for interengagement in the recesses in the adjacent end of the mating card, the projections being movable seriatim into and out of the recesses in response to pivoting of the lever arm to thereby insert the card into the cavity in response to pivoting the lever arm toward said latched position and to eject the electrical component from the cavity in response to pivoting the lever means toward said eject position.

14. The injection and ejection connector assembly of claim 13, including a third projection on the lever arm against which the mating card is engageable upon initial insertion of the card and prior to engagement of said pair of spaced projections in said pair of recesses.

15. The injection and ejection connector assembly of claim 13 including stop means between the insertion and ejection lever arm and the housing to define said eject position.

* * * * *